US009845712B2

(12) United States Patent
Hayden

(10) Patent No.: US 9,845,712 B2
(45) Date of Patent: Dec. 19, 2017

(54) THREE-STEP SLIDING VARIABLE CAM

(71) Applicant: GM GLOBAL TECHNOLOGY OPERATIONS LLC, Detroit, MI (US)

(72) Inventor: David N. Hayden, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 115 days.

(21) Appl. No.: 15/071,578

(22) Filed: Mar. 16, 2016

(65) Prior Publication Data

US 2017/0268391 A1 Sep. 21, 2017

(51) Int. Cl.
*F01L 1/34* (2006.01)
*F01L 13/00* (2006.01)
*F01L 1/047* (2006.01)

(52) U.S. Cl.
CPC ..... *F01L 13/0005* (2013.01); *F01L 1/047* (2013.01); *F01L 2013/001* (2013.01)

(58) Field of Classification Search
CPC .. F01L 13/0005; F01L 1/047; F01L 2013/001
USPC ..... 123/90.16, 90.18, 90.6
See application file for complete search history.

(56) References Cited

U.S. PATENT DOCUMENTS 9,534,512 B2 * 1/2017 McConville ..... F01L 1/22 123/90.18

* cited by examiner

*Primary Examiner* — Ching Chang
(74) *Attorney, Agent, or Firm* — Quinn IP Law

(57) ABSTRACT

A cam system for operating a first engine valve and a second engine valve includes translatable first and a second sliding lobe packs. The first sliding lobe pack operates the first engine valve with one of a high lift lobe, a low lift lobe, and a zero lift lobe. The second sliding lobe operates the second engine valve with one of a high lift lobe or one of two low lift lobes. A shift barrel has a first groove configured to translate the first and a second sliding lobe packs in a first direction, and a second groove configured to translate the first and a second sliding lobe packs in a second direction, opposite the first. A shift actuator has a first pin, a second pin, and a third pin, each selectively actuatable to engage the first groove or the second groove.

12 Claims, 5 Drawing Sheets

THREE-STEP SLIDING VARIABLE CAM

TECHNICAL FIELD

This disclosure generally relates to variable cam systems.

BACKGROUND

Camshafts are rotating mechanical linkages used for transforming rotary motion into linear motion. Some internal combustion engines utilize camshafts to operate valves that control intake and exhaust from cylinders.

SUMMARY

A cam system for operating a first engine valve and a second engine valve is provided. The cam system includes a first sliding lobe pack and a second sliding lobe pack.

The first sliding lobe pack is translatable relative to the first engine valve, and is configured to operate the first engine valve with one of a high lift lobe, a low lift lobe, and a zero lift lobe. The second sliding lobe pack is translatable relative to the second engine valve, and is configured to operate the second engine valve with one of a high lift lobe or a low lift lobe.

A shift barrel is attached to the first sliding lobe pack and the second sliding lobe pack. The shift barrel has a first groove configured to translate the first sliding lobe pack and the second sliding lobe pack in a first direction, and a second groove configured to translate the first sliding lobe pack and the second sliding lobe pack in a second direction, which is opposite the first direction.

A shift actuator has a first pin, a second pin, and a third pin. The first pin, second pin, and third pin are each selectively actuatable to engage one of the first groove and the second groove of the shift barrel.

The above features and advantages, and other features and advantages, of the present subject matter are readily apparent from the following detailed description of some of the best modes and other embodiments for carrying out the disclosed structures, methods, or both.

DETAILED DESCRIPTION

Figure 1:
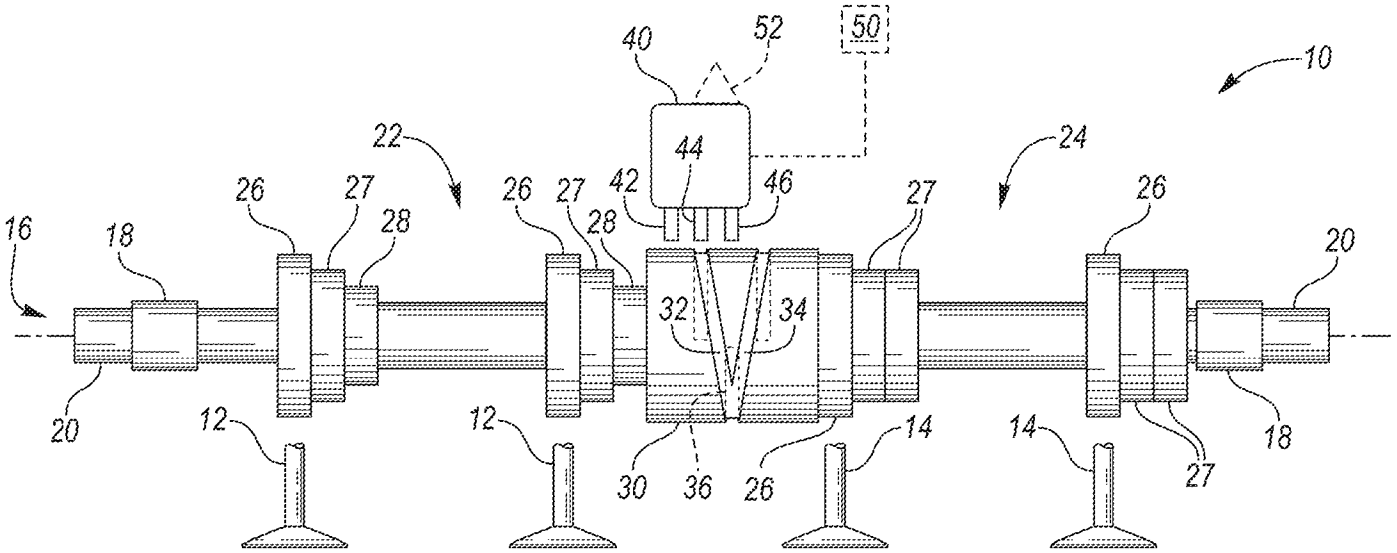
FIG. 1 is a schematic view of a cam system for a vehicle, illustrating two sliding lobe packs variably actuating valves of two cylinder banks at a high lift state.

In the drawings, like reference numbers correspond to like or similar components whenever possible throughout the several figures. There is shown in FIG. 1 a cam system 10 for operating at least one first engine valve 12 and at least one second engine valve 14 of a vehicle (not shown). The first engine valves 12 and the second engine valves 14 are within respective first and second cylinders (not shown) or cylinder banks of an internal combustion engine (not shown). The cam system 10 shown may also be used on a single cylinder.

A camshaft assembly 16 is supported by a plurality of bearings 18, such that the camshaft assembly 16 is rotatable relative to the cylinder banks. As described herein, rotation of the camshaft assembly 16 variably actuates the first engine valves 12 and the second engine valves 14 to facilitate combustion within the cylinder banks and production of mechanical energy by the engine. Additional bearings 18 may be incorporated into the camshaft assembly 16.

The first engine valves 12 and the second engine valves 14 are poppet valves used to control the timing and quantity of fuel and air flow into the engine. The structures of the cylinders—such as valve seats, cylinder walls, etc.—are not shown in the figures.

While the present disclosure may be described with respect to specific applications or industries, those skilled in the art will recognize broader applicability. Those having ordinary skill in the art will recognize that terms such as "above," "below," "upward," "downward," et cetera, are used descriptively of the figures, and do not represent limitations on the scope of the disclosure, as defined by the appended claims. Any numerical designations, such as "first" or "second" are illustrative only and are not intended to limit the scope of the disclosure in any way.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and those shown are not limiting of the claims or the description.

Although the cam system 10 is described and illustrated with reference to the technology of internal combustion engines, which includes spark-ignited and compression ignited engines, the structures and functions of the cam system 10 are usable in other technological areas. The cam system 10 is applicable to any cam-driven valve technology, including valves used to control flow of other fluids or solids. For example, plastic molding equipment may utilize iterative injection of solid or liquid plastics into molds. Additionally, the cam system 10 may be used to control other iterative structures, technologies, or assemblies, such as actuating manufacturing devices. In general, cams provide iterative and controllable physical actuation from rotating movement, and the cam system 10 may be utilized with any such system.

As shown in FIG. 1, the cam system 10 includes a fixed shaft 20, which is rotatable relative to the first engine valves 12 and the second engine valves 14, but does not otherwise translate horizontally or move vertically (as viewed in the figures). A first sliding lobe pack 22 is translatable relative to the first engine valves 12 and the fixed shaft 20, and a second sliding lobe pack 24 is translatable relative to the second engine valves 14 and the fixed shaft 20. The first sliding lobe pack 22 and the second sliding lobe pack 24 may be splined, or otherwise keyed, for common rotation with the fixed shaft 20.

The first sliding lobe pack 22 is configured to operate the first engine valves 12 with one of a high lift lobe 26, a low lift lobe 27, and a zero lift lobe 28. The second sliding lobe pack 24 is configured to operate the second engine valves 14 with one of a high lift lobe 26 or either of two low lift lobes 27, which impart substantially identical displacement, and may be combined into a single low lift lobe 27 in some configurations. Any of the individual lobes described herein and shown in the figures may be referred to numerically, as first, second, third, or the like.

As described herein, translation of the first sliding lobe pack 22 and the second sliding lobe pack 24 selectively aligns the high lift lobes 26, the low lift lobes 27, and the zero lift lobes 28 with the first engine valves 12 and the second engine valves 14. Alignment of the specific lobes selectively varies the displacement of the first engine valves 12 and the second engine valves 14.

The lobes are illustrated only schematically in the figures, such that the lobes shown represent only relative maximum displacement of the first engine valves 12 and the second engine valves 14. Therefore, the high lift lobes 26 impart greater motion to the first engine valves 12 and the second engine valves 14 than the low lift lobes 27. The zero lift lobes 28 impart substantially no lift to the first engine valves 12, such that the first engine valves 12 may be selectively deactivated.

The first sliding lobe pack 22 and the second sliding lobe pack 24 may be separately translatable relative to the first engine valves 12 and the second engine valves 14. However, in the configuration shown, the first sliding lobe pack 22 and the second sliding lobe pack 24 are connected for common translation by a shift barrel 30 that is attached to the first sliding lobe pack 22 and the second sliding lobe pack 24.

Based on alignment of the high lift lobes 26, the low lift lobes 27, and the zero lift lobes 28 relative to the first engine valves 12 and the second engine valves 14, the cam system 10 operates at a plurality of variable cam stages or states, including: a high lift state, a low lift state, and a cylinder deactivation or active fuel management state. Each of the operating states varies the amount of air and fuel entering the first cylinder bank and the second cylinder bank, which varies the operation of the engine.

Figure 2:
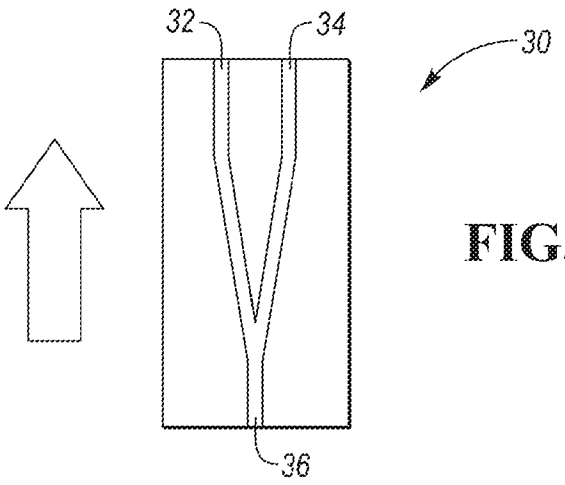
FIG. 2 is a schematic circumferential or unspooled view of a first shift groove and a second shift groove in a shift barrel of the cam system shown in FIG. 1.

Referring also to FIG. 2, there is shown a circumferential or unspooled view of the shift barrel 30. The view of FIG. 2 illustrates the shift barrel 30 as if its exterior has been rolled onto a flat plane. As shown in FIG. 2, and partially viewable in FIG. 1, the shift barrel 30 has a first groove 32 and a second groove 34, which join into a common groove 36.

As shown in FIG. 1, a shift actuator 40 is fixedly disposed adjacent the shift barrel 30. The shift actuator 40 has a first pin 42, a second pin 44, and a third pin 46. The shift actuator 40 selectively deploys, fires, or actuates the first pin 42, the second pin 44, and the third pin 46, which may then engage one of the first groove 32 and the second groove 34 of the shift barrel 30.

The first groove 32 and the second groove 34 are configured to act in opposing directions. Therefore, firing one of the pins into the first groove 32 translates both the first sliding lobe pack 22 and the second sliding lobe pack 24 in a first direction (leftward, as illustrated in the figures); and firing one of the pins into the second groove 34 translates both the first sliding lobe pack 22 and the second sliding lobe pack 24 in the opposite direction (rightward, as illustrated in the figures). In the configuration shown, the shift actuator 40 is a single actuator for all of the first engine valves 12 and the second engine valves 14, as opposed to having one actuator related to the first cylinder bank and another related to the second cylinder bank.

Referring now to FIGS. 3A-6B, and with continued reference to FIGS. 1-2, there are shown additional views of the cam system 10 that illustrate interaction between the shift actuator 40 and the shift barrel 30 to place the cam system 10 into one of three states. Based on location of the first sliding lobe pack 22 and second sliding lobe pack 24, the cam system 10 operates at either the high lift state, the low lift state, or the cylinder deactivation state.

In the high lift state, the first sliding lobe pack 22 actuates the first engine valves 12 with the high lift lobes 26 and the second sliding lobe pack 24 actuates the second engine valves 14 with the high lift lobes 26. In the low lift state, the first sliding lobe pack 22 actuates the first engine valves 12 with the low lift lobes 27 and the second sliding lobe pack 24 actuates the second engine valves 14 with the low lift lobes 27. In the cylinder deactivation state, the first sliding lobe pack 22 actuates the first engine valves 12 with the zero lift lobes 28 and the second sliding lobe pack 24 actuates the second engine valves 14 with the low lift lobes 27.

Figure 3A:
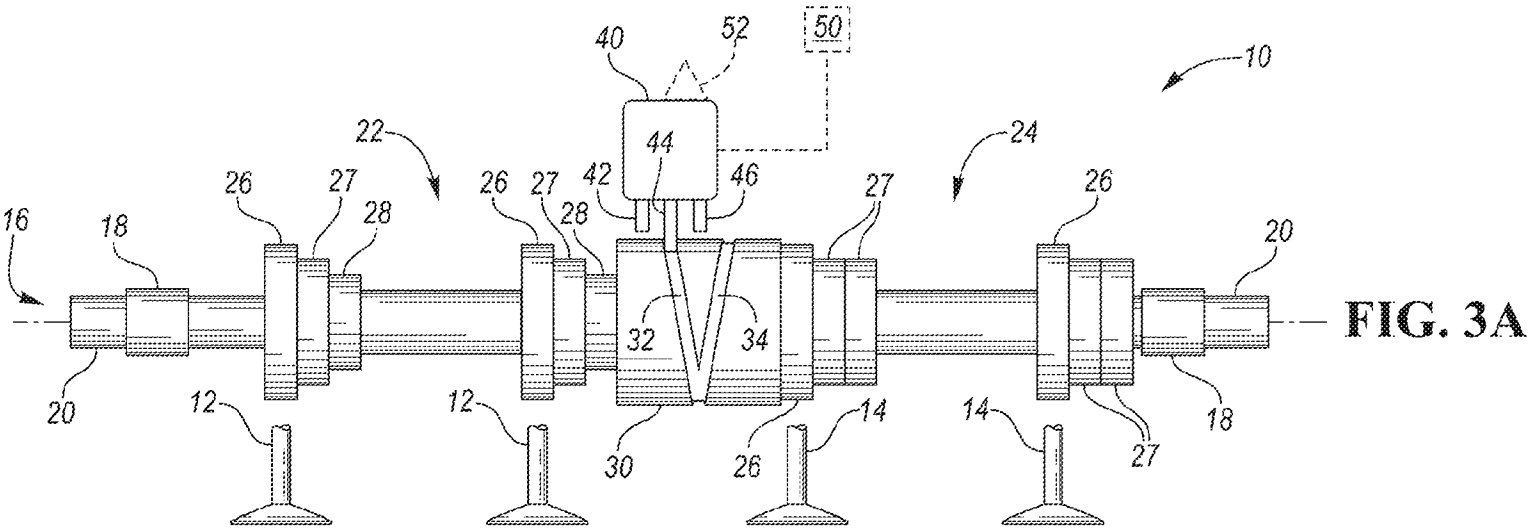
FIG. 3A is a schematic view of the cam system of FIG. 1 illustrating a shift actuator firing a second pin into the first shift groove.
Figure 3B:
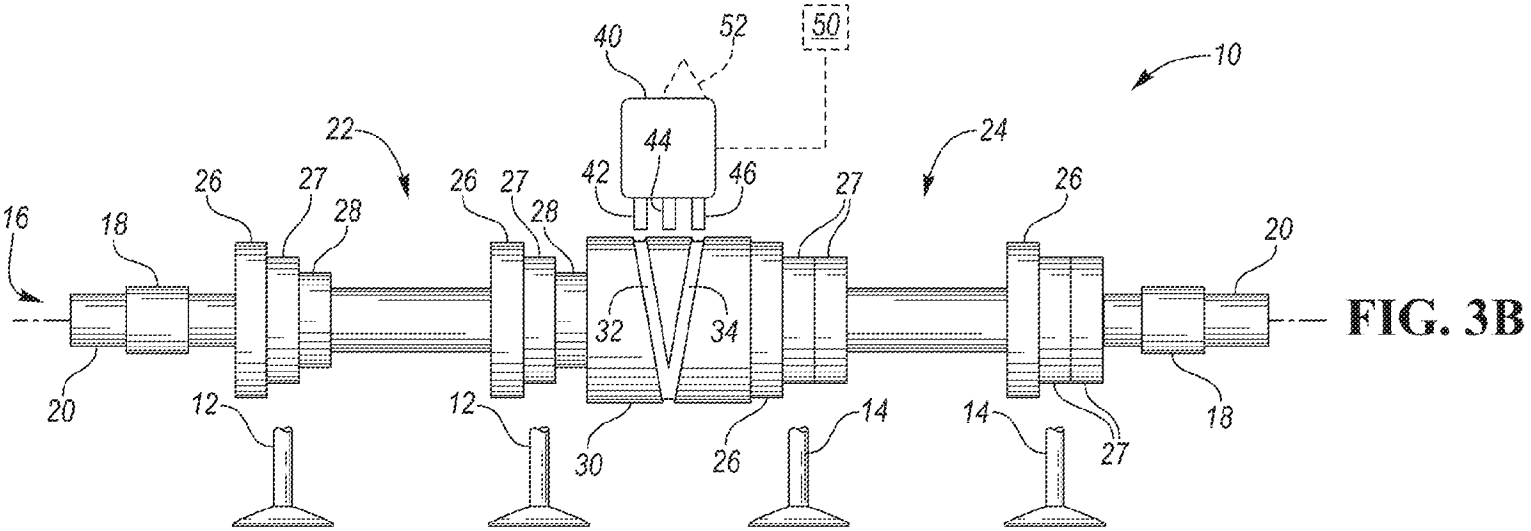
FIG. 3B is a schematic view illustrating a low lift state resulting from FIG. 3A.

FIG. 3A shows the cam system 10 in the high lift state, but with the shift actuator 40 firing the second pin 44 into the first shift groove 32. Therefore, the second pin 44 and the first shift groove 32 will cause the first sliding lobe pack 22 and the second sliding lobe pack 24 to translate to the left (as viewed in the figures). FIG. 3B shows the result of the actuation shown in FIG. 3A. In FIG. 3B, the cam system 10 has been placed into the low lift state by actuation of the second pin 44 of the shift actuator 40.

After the second pin 44 moves through the first shift groove 32 to the common shift groove 36, which occurs during approximately one rotation of the cam assembly 16, the second pin 44 retracts or ejects from the shift barrel 30. The common groove 36 may include a retraction feature, such as a ramp or other structure, configured to release or push away whichever pin is engaged therewith. For example, and without limitation, the end of the common groove 36 (at the bottom, as viewed in FIG. 2) may taper or angle the common groove 36 to zero depth, such that the pins would then ride on the surface of the shift barrel 30.

Alternatively, or in combination with retraction features in the common groove 36, the shift actuator 40 may be configured to retract whichever pin has been deployed into the shift barrel 30. For example, and without limitation, return springs may constantly bias the first pin 42, the second pin 44, and the third pin 46 back into the shift actuator 40, such that actuation or deployment of the pins continues only while an actuation force opposing the spring force is applied thereto.

Figure 4A:
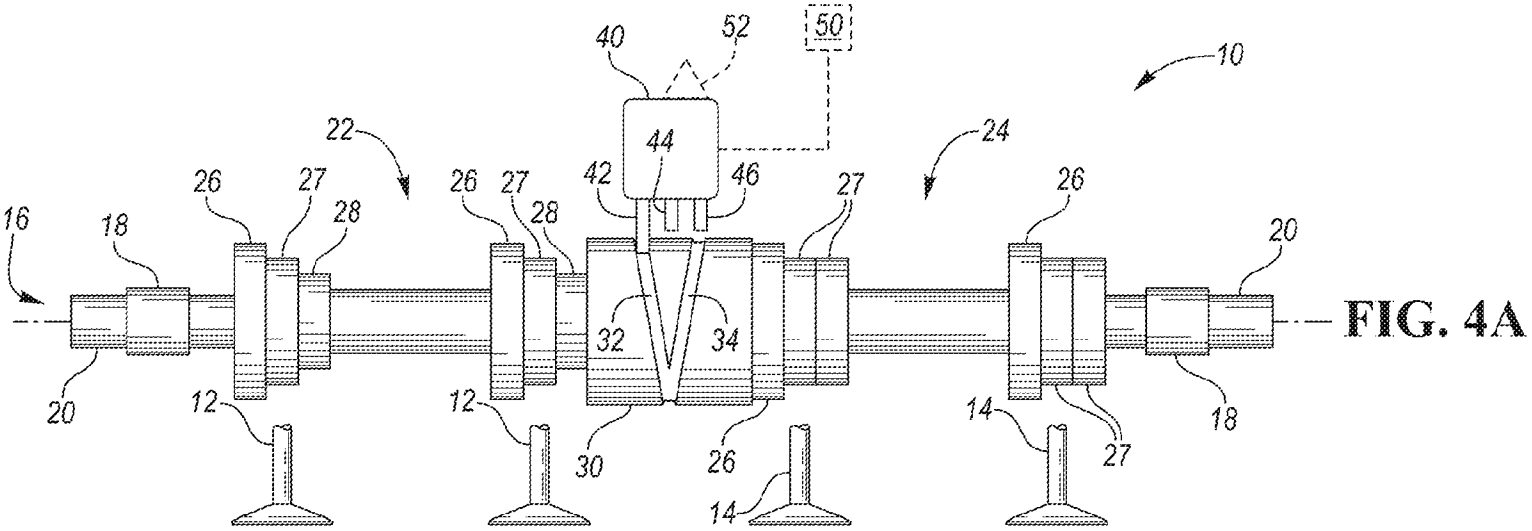
FIG. 4A is a schematic view of the cam system of FIG. 1 illustrating the shift actuator firing a first pin into the first shift groove.
Figure 4B:
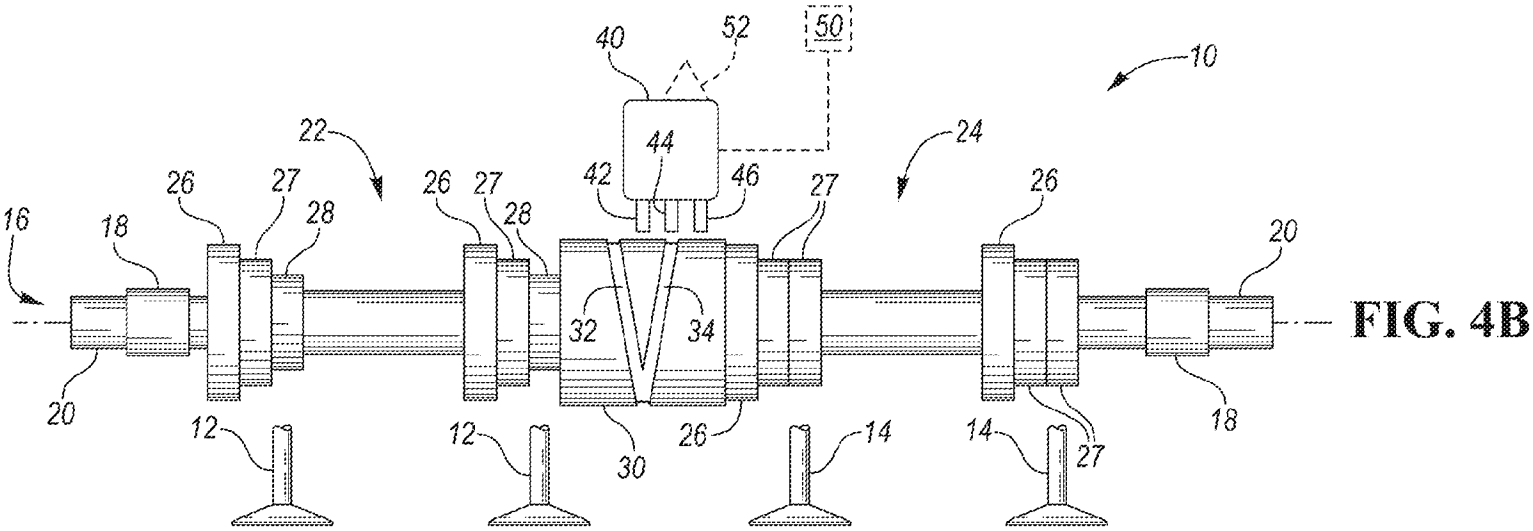
FIG. 4B is a schematic view illustrating a cylinder deactivation state resulting from FIG. 4A.

FIG. 4A shows the cam system 10 in the low lift state, but with the shift actuator 40 firing the first pin 42 into the first shift groove 32. Therefore, the first pin 42 and the first shift groove 32 will cause the first sliding lobe pack 22 and the second sliding lobe pack 24 to translate to the left (as viewed in the figures). FIG. 4B shows the result of the actuation shown in FIG. 4A.

In FIG. 4B, the cam system 10 has been placed into the cylinder deactivation state by actuation of the first pin 42 of the shift actuator 40. Note that in the cylinder deactivation state, the first engine valves 12 are at zero lift or displacement, such that the first cylinder bank is not producing any mechanical energy. However, the second engine valves 14 are at low lift or displacement, such that the second cylinder bank is producing mechanical energy.

Figure 5A:
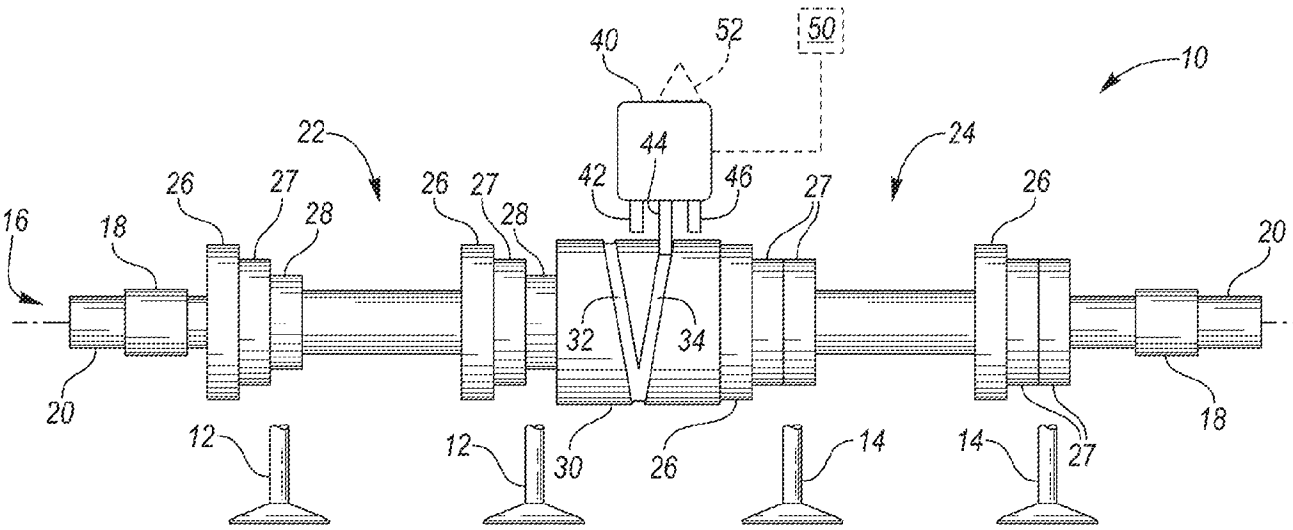
FIG. 5A is a schematic view of the cam system of FIG. 1 illustrating the shift actuator firing the second pin into the second shift groove.
Figure 5B:
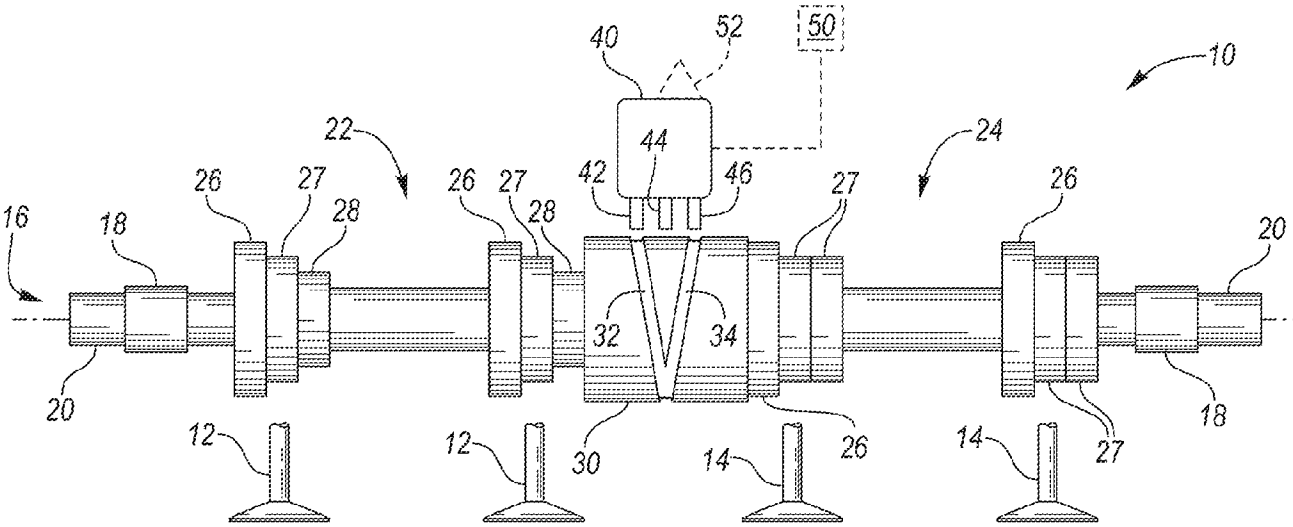
FIG. 5B is a schematic view illustrating the low lift state resulting from FIG. 5A.

FIG. 5A shows the cam system 10 in the cylinder deactivation state, but with the shift actuator 40 firing the second pin 44 into the second shift groove 34. Therefore, the second pin 44 and the second shift groove 34 will cause the first sliding lobe pack 22 and the second sliding lobe pack 24 to translate to the right (as viewed in the figures). FIG. 5B shows the result of the actuation shown in FIG. 5A.

In FIG. 5B, the cam system 10 has been placed into the low lift state by actuation of the second pin 44 of the shift actuator 40. Note that firing the second pin 44 into either the first shift groove 32 or the second shift groove 34 results in the cam system 10 operating at the low lift state.

Figure 6A:
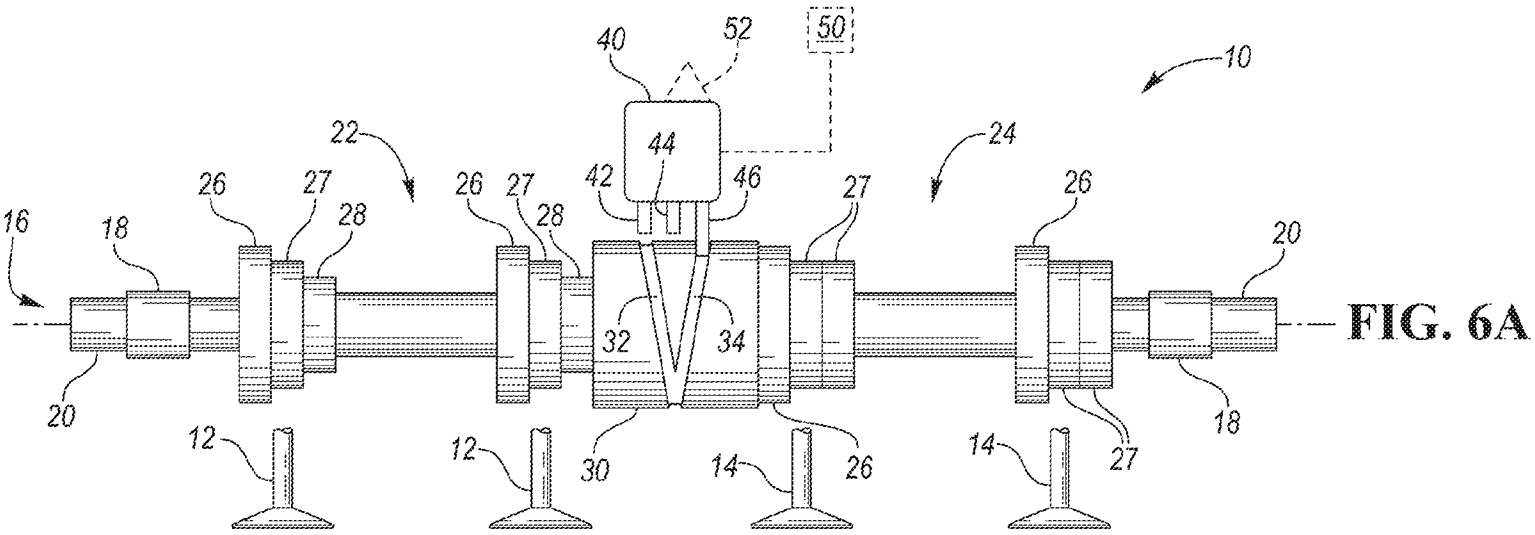
FIG. 6A is a schematic view of the cam system of FIG. 1 illustrating the shift actuator firing a third pin into the second shift groove.
Figure 6B:
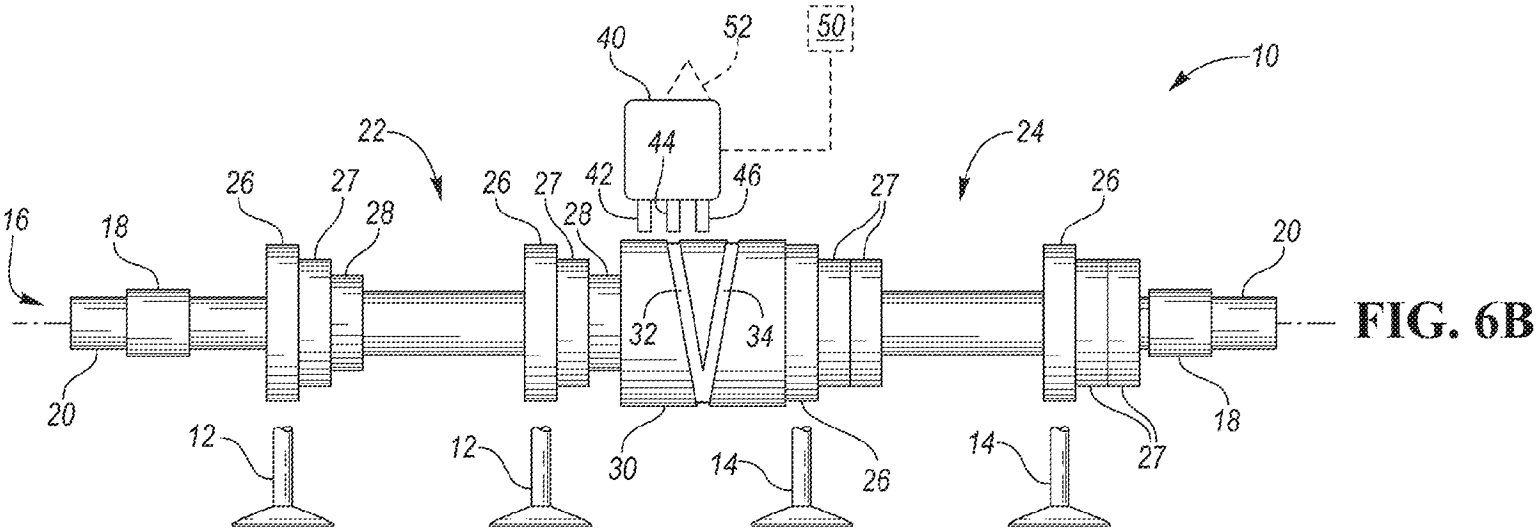
FIG. 6B is a schematic view illustrating the high lift state resulting from FIG. 6A.

FIG. 6A shows the cam system 10 in the low lift state, but with the shift actuator 40 firing the third pin 46 into the second shift groove 34. Therefore, the third pin 46 and the second shift groove 34 will cause the first sliding lobe pack 22 and the second sliding lobe pack 24 to translate to the right (as viewed in the figures). FIG. 6B shows the result of the actuation shown in FIG. 6A. In FIG. 6B, the cam system 10 has been placed into the high lift state by actuation of the third pin 46 of the shift actuator 40.

As illustrated by FIGS. 5A-6B, consecutively actuating the second pin 44 and the third pin 46 of the shift actuator 40 into the second shift groove 34 moves the cam system 10 from the cylinder deactivation state to the high lift state, via the low lift state. Similarly, as illustrated by FIGS. 3A-4B, consecutively actuating the second pin 44 and the first pin 42 of the shift actuator 40 into the first shift groove 32 moves the cam system 10 from the high lift state to the cylinder deactivation state, via the low lift state.

FIG. 1 schematically illustrates the cam system 10 with a control system or controller 50 that is in communication with the shift actuator 40, as illustrated in FIG. 1. The controller 50 is configured to instruct the shift actuator 40 to actuate one of the first pin 42, the second pin 44, and the third pin 46. The controller 50 may also monitor the current state of the cam system 10, and may be involved with determining which of the states is currently preferred for operation of the vehicle.

The controller 50 may be representative of the entire control and computational architecture of the vehicle, or may be dedicated to the cam system 10. The controller 50 includes a sufficient amount of memory and processing power to receive signal inputs from, and output commands, data, or instructions to, all systems over which the controller 50 is in command or monitoring.

The controller 50 is an electronic device that is configured, i.e., constructed and programmed, to regulate systems and components of the vehicle. The controller 50 may be configured as a central processing unit (CPU) that is also configured to regulate operation of the engine or other primary movers. Alternatively, the controller 50 may be a dedicated controller for only the systems discussed herein. The controller 50 includes a memory, at least some of which is tangible and non-transitory. The memory may be any recordable medium that participates in providing computer-readable data or process instructions. Such a medium may take many forms, including but not limited to non-volatile media and volatile media.

Non-volatile media for the controller 50 may include, for example, optical or magnetic disks and other persistent memory. Volatile media may include, for example, dynamic random access memory (DRAM), which may constitute a main memory. Such instructions may be transmitted by one or more transmission medium, including coaxial cables, copper wire and fiber optics, including the wires that comprise a system bus coupled to a processor of a computer. Memory of the controller 50 may also include a floppy disk, a flexible disk, hard disk, magnetic tape, any other magnetic medium, a CD-ROM, DVD, any other optical medium, etc. The controller 50 can be configured or equipped with other required computer hardware, such as a high-speed clock; requisite Analog-to-Digital (A/D) and Digital-to-Analog (D/A) circuitry; input output circuitry and devices (I/O); as well as appropriate signal conditioning and buffer circuitry. Any algorithms required by the controller 50 or accessible thereby may be stored in the memory and automatically executed to provide the required functionality.

The cam system 10 may also include a sensor 52 in communication with the shift actuator 40 and the controller 50, as illustrated in FIG. 1. The sensor 52 is configured to determine whether one of the first pin 42, the second pin 44, and the third pin 46 has been actuated, and may be, for example and without limitation, a hall effect sensor. The single actuator 40 may allow the cam system to use only the single sensor 52, as opposed to multiple sensors associated with each of the first sliding lobe pack 22 and the second sliding lobe pack 24.

In many configurations, it may be difficult to determine the exact position of the first sliding lobe pack 22 and the second sliding lobe pack 24 or the amount of displacement of the first engine valves 12 and the second engine valves 14. This may cause uncertainty, particularly if one of the pins fires but is unsuccessful in engaging the first shifting groove 32 or the second shifting groove 34, or if one of the pins is commanded to fire but does not do so.

The specific operating state of the cam system 10 may be known or determined based on iteration, such that the controller 50 records each state transition from a base point. Alternatively, the cam system 10 may determine the operating state through absolute means, such that the controller 50 determines or knows the operating state by sensing, for example, operating conditions of the engine.

Successful firing and engagement of the second pin 44 always places the cam system 10 into the low lift state, regardless of the previous state of operation. Therefore, the second pin 44 may be consecutively fired to ensure that the cam system 10 is in a known state (somewhat like a home position). Note that firing of the second pin 44 while the cam system 10 is already in the low life state may result in the second pin 44 simply striking the shift barrel 30 or the common groove 36, which does not move the cam system 10 away from the low lift state.

The detailed description and the drawings or figures are supportive and descriptive of the subject matter discussed herein. While some of the best modes and other embodiments for have been described in detail, various alternative designs, configurations, and embodiments exist.

The invention claimed is:

1. A cam system for operating a first engine valve and a second engine valve, comprising:

a first sliding lobe pack translatable relative to the first engine valve, wherein the first sliding lobe pack is configured to operate the first engine valve with one of a first high lift lobe, a first low lift lobe, and a zero lift lobe;

a second sliding lobe pack translatable relative to the second engine valve, wherein the second sliding lobe pack is configured to operate the second engine valve with one of a second high lift lobe, a second low lift lobe, and a third low lift lobe;

a shift barrel attached to the first sliding lobe pack and the second sliding lobe pack, wherein the shift barrel has a first groove configured to translate the first sliding lobe pack and the second sliding lobe pack in a first direction, and a second groove configured to translate the first sliding lobe pack and the second sliding lobe pack in a second direction, opposite the first direction; and a shift actuator having a first pin, a second pin, and a third pin, each of which is selectively actuatable to engage one of the first groove and the second groove of the shift barrel.

2. The cam system of claim 1, wherein the first sliding lobe pack and second sliding lobe pack are configured to selectively operate the cam system at one of:

a high lift state, wherein the first sliding lobe pack actuates the first engine valve with the first high lift lobe and the second sliding lobe pack actuates the second engine valve with the second high lift lobe;

a low lift state, wherein the first sliding lobe pack actuates the first engine valve with the first low lift lobe and the second sliding lobe pack actuates the second engine valve with the second low lift lobe; and a cylinder deactivation state, wherein the first sliding lobe pack actuates the first engine valve with the zero lift lobe and the second sliding lobe pack actuates the second engine valve with the third low lift lobe.

3. The cam system of claim 2, wherein actuating the second pin of the shift actuator places the cam system in the low lift state.

4. The cam system of claim 3, wherein actuating the first pin of the shift actuator moves the cam system from the low lift state to the cylinder deactivation state.

5. The cam system of claim 4, wherein actuating the third pin of the shift actuator moves the cam system from the low lift state to the high lift state.

6. The cam system of claim 5, wherein consecutively actuating the second pin and the first pin of the shift actuator moves the cam system from the high lift state to the cylinder deactivation state.

7. The cam system of claim 6, wherein consecutively actuating the second pin and the third pin of the shift actuator moves the cam system from the cylinder deactivation state to the high lift state.

8. The cam system of claim 7, further comprising:

a controller in communication with the shift actuator and configured to instruct the shift actuator to actuate one of the first pin, the second pin, and the third pin.

9. The cam system of claim 8, further comprising:

a hall effect sensor in communication with the shift actuator and configured to determine whether one of the first pin, the second pin, and the third pin has been actuated.

10. The cam system of claim 1, further comprising:

a controller in communication with the shift actuator and configured to instruct the shift actuator to actuate one of the first pin, the second pin, and the third pin; and a hall effect sensor in communication with the shift actuator and configured determine whether one of the first pin, the second pin, and the third pin has been actuated.

11. A cam system for operating a first engine valve and a second engine valve, comprising:

a first sliding lobe pack translatable relative to the first engine valve, wherein the first sliding lobe pack is configured to operate the first engine valve with one of a first high lift lobe, a first low lift lobe, and a zero lift lobe;

a second sliding lobe pack translatable relative to the second engine valve, wherein the second sliding lobe pack is configured to operate the second engine valve with one of a second high lift lobe, a second low lift lobe, and a third low lift lobe;

a shift barrel attached to the first sliding lobe pack and the second sliding lobe pack, wherein the shift barrel has a first groove configured to translate the first sliding lobe pack and the second sliding lobe pack in a first direction, and a second groove configured to translate the first sliding lobe pack and the second sliding lobe pack in a second direction, opposite the first direction;

a shift actuator having a first pin, a second pin, and a third pin, each of which is selectively actuatable to engage one of the first groove and the second groove of the shift barrel; and a controller in communication with the shift actuator and configured to instruct the shift actuator to actuate one of the first pin, the second pin, and the third pin, wherein the controller is configured to instruct the shift actuator to actuate one of the first pin, the second pin, and the third pin, such that the first sliding lobe pack and second sliding lobe pack selectively operate the cam system at one of:

a high lift state, wherein the first sliding lobe pack actuates the first engine valve with the first high lift lobe and the second sliding lobe pack actuates the second engine valve with the second high lift lobe;

a low lift state, wherein the first sliding lobe pack actuates the first engine valve with the first low lift lobe and the second sliding lobe pack actuates the second engine valve with the second low lift lobe; and a cylinder deactivation state, wherein the first sliding lobe pack actuates the first engine valve with the zero lift lobe and the second sliding lobe pack actuates the second engine valve with the third low lift lobe.

12. The cam system of claim 11, further comprising:

a hall effect sensor in communication with the shift actuator and configured to determine whether one of the first pin, the second pin, and the third pin has been actuated.

* * * * *